US005267810A

United States Patent [19]

Johnson

[11] Patent Number: 5,267,810

[45] Date of Patent: Dec. 7, 1993

[54] PAVING BLOCK

[76] Inventor: Christopher M. Johnson, 318 Penley Ave., Sandston, Va. 23150

[21] Appl. No.: 765,441

[22] Filed: Sep. 25, 1991

[51] Int. Cl.[5] ..... E01C 5/06

[52] U.S. Cl. ..... 404/41; 404/42

[58] Field of Search ..... 404/41, 42, 38; 52/311

[56] References Cited

U.S. PATENT DOCUMENTS

| | | | |
|---|---|---|---|
| 2,836,055 | 5/1958 | Shuman | 404/38 X |
| 4,773,790 | 9/1988 | Hagenah | 404/41 |
| 4,919,565 | 4/1990 | Göpfert | 404/414 |

FOREIGN PATENT DOCUMENTS

| | | | |
|---|---|---|---|
| 670640 | 10/1964 | Belgium | 404/41 |
| 228496 | 7/1987 | European Pat. Off. | 404/42 |
| 3116540 | 11/1982 | Fed. Rep. of Germany | 404/41 |

*Primary Examiner*—William P. Neuder

[57] ABSTRACT

A unique shaped paving block having a top face, bottom face and 18 flat sides that permits its ready placement by being rotated 60 degrees or less to orient with blocks already in position. The six groups of three exterior and interior sides or faces with an intermediate joining side face provides lock points so that the block is especially usable in high loading areas such as industrial applications and applications at airports.

10 Claims, 2 Drawing Sheets

PAVING BLOCK

This invention relates to paving blocks.

BACKGROUND OF THE INVENTION

Paving blocks, sometimes called pavers, have become a standard pavement surface in Europe and have become of increasing popularity in the United States. Usually the paving blocks are made from concrete. Low maintenance and aesthetic appeal have been two of the primary reasons for their use. Initially they were an alternative to conventional concrete and asphalt pavement in light duty applications such as driveways and pedestrian malls. But, more recently, concrete paving blocks have become popular for heavy duty applications including streets, airports, gas stations, trucking terminals, railroad yards and ports.

Interlocking concrete pavement blocks have become of special interest for airfields and have been successfully utilized for a slow moving and static aircraft loading such as turning areas, taxiways and aprons. Some advantages of use include reducing runway closure times and airline costs due to delays in installation, durability, and reduced downtime for maintenance. However, there has been a resistance to using the interlocking concrete paving blocks for high speed runways.

SUMMARY OF THE INVENTION

The interlocking paving block of the present invention provides a flexible pavement system with a high degree of load transfer by a unique shape. The result is more uniform load distribution due to a high degree of vertical load transfer, a better flexible resistance to limited pavement deflection under point load and a greater resistance to pavement migration especially when aircraft is turning. Some of the other advantages of the unique shaped paving block are its ability to tolerate and correct misalignment, improved dissipation of lateral forces in multiple directions, the ability to line up with already installed blocks by being rotated only a maximum of 60 degrees when being installed and the ability to be installed 19 blocks at a time by mechanical equipment with highly efficient speeds.

Generally the unique paving block of the invention has parallel top and bottom faces and 18 sides consisting of six groups of three vertical faces. The three vertical faces of each group each include two faces of substantially the same width connected together by a relatively short intermediate face which provides a locking area for the block. The blocks are preferably made of concrete which in normal practice, as is well known in the art, can be made with a minimum strength of 7,500 pounds per square inch and is usually 8,000 pounds per square inch and can be as strong as 11,500 pounds per square inch or stronger.

A better understanding of the details of the special features of the block will be appreciated with reference to the description of the preferred embodiment. In this description, including the accompanying drawings, there is shown and described a preferred embodiment of the invention. Others skilled in the art will understand the invention and the principles thereof and will be able to modify the preferred embodiment and utilize the invention in a variety of forms, each as may be suited for the conditions of a particular case.

DETAILED DESCRIPTION OF THE INVENTION

Figure 1:
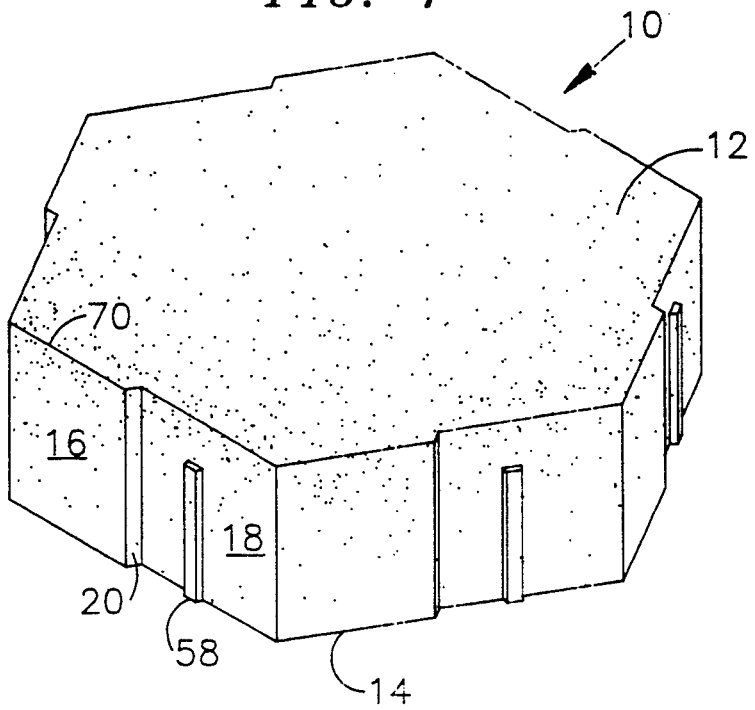
FIG. 1 is a perspective view of the paving block of the present invention.
Figure 2:
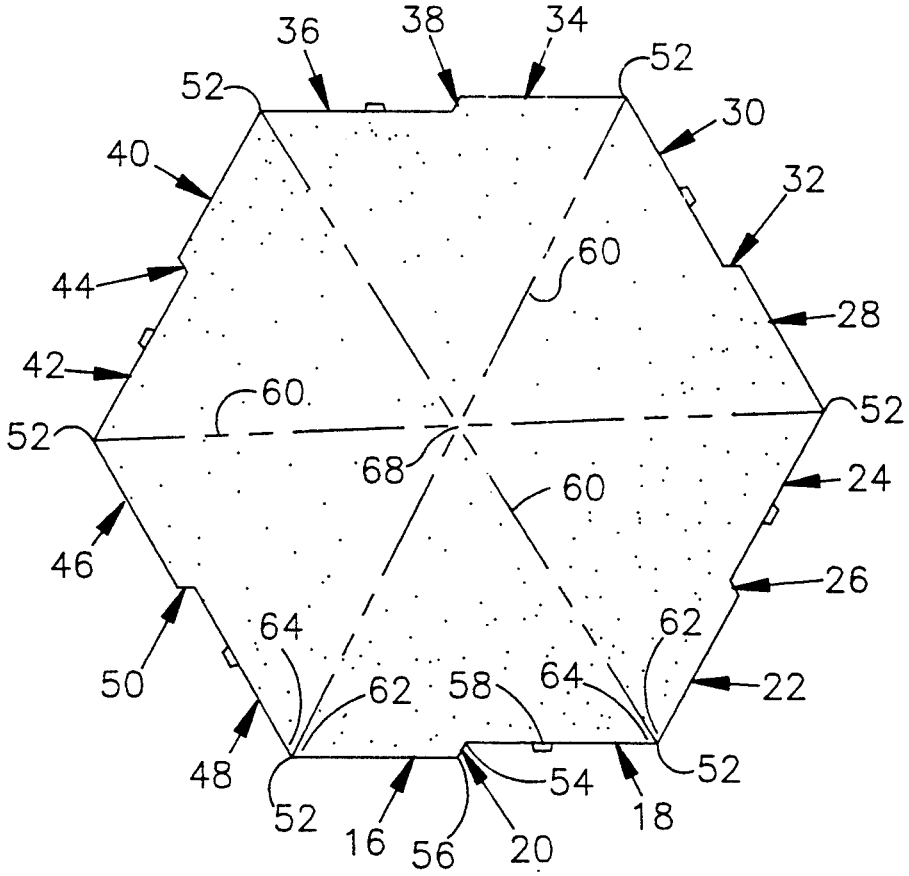
FIG. 2 is a plan view of the block of FIG. 1.

With reference to FIGS. 1 and 2 there is shown the paving block 10 of the present invention. The block has a substantially flat top face 12 and a substantially flat bottom face 14. The plane of the top face 12 and bottom face 14 are parallel to on another. The side of the block is divided into six group of three sides of faces each.

Each group is identical to one another and the first group has an exterior face 16 and interior face 18 and an intermediate face 20 that connects the interior face and exterior face. The exterior face 16 and interior face 18 are both of the same height and width and the connecting or intermediate face 20 is of the same height but of a much narrower width. In the preferred embodiment the width of the interior and exterior face is 6 cm. and the intermediate face 1.2 cm.

The other five groups of faces have identical exterior faces 22, 28, 34, 40 and 46 to exterior face 16. Likewise, the remaining five interior faces 24, 30, 36, 42 and 48 and intermediate faces 26, 32, 38, 44 and 50 are the same as the interior face and intermediate face of the first group. The six groups of faces are delineated and connected to one another by six primary corners 52. In each group of faces the interior face is delineated and connected to the intermediate face by interior corners 54 and the exterior face is delineated by and connected to the intermediate face by exterior corner 56.

All of the 18 sides or faces are substantially vertical and flat. However, spacer bars 58 are preferably placed on either all six exterior faces or six interior faces but not both. The spacer bars 58 are relatively narrow in width and extend vertically from the vicinity of the bottom face 14 to near the top face 12. They are foreshortened and do not actually reach the top face by an amount equal to the height of the chamfer 70 which runs along the intersection of the top face with the 18 side faces. Preferably the chamfer is approximately $\frac{1}{4}$ inch in radius and the other corners of the block are approximately 1/16 inch to $\frac{1}{8}$ inch in radius. The spacer bars 58 are approximately 1.5 mm. in height or thickness and may vary from 0.5 to 3 mm. in height or thickness. This provides an offset spacing between paving blocks which is filled with sand. The spacing decreases the likelihood of adjacent paving blocks causing spalling or edge chipping of one another as they are flexed under load.

The major horizontal distance or maximum width of the paving block is shown by lines 60 which connects two opposite primary corners 52. The preferred maximum width or major horizontal dimension is approximately 25 cm. but it may vary between approximately 15 cm. and approximately 30 cm. The spacing between the top face 12 and bottom face 14, or height of the block, is preferably approximately 10 cm. and may vary between approximately 9 cm. and approximately 12 cm.

The major angle 62 between the exterior face and the plane passing through major horizontal distance line 60 is preferably 65 degrees and may vary between approximately $62\frac{1}{2}$ and $67\frac{1}{2}$ degrees. The minor angle between the interior face and the plane in which the major horizontal distance line 60 lies is identified as 64 and is approximately 55 degrees and may vary between approximately 57½ degrees and 52½ degrees. Two adjacent angles, major angle 62 and minor angle 64, define the primary corner 52 which encloses an angle of 120 degrees. The interior angle 68, between two adjacent horizontal distant lines 60, is 60 degrees. The plane of the intermediate face 20, 26, 32, 38, 44 and 50 lie approximately parallel to the plane in which one of the adjacent major horizontal distant lines lies (the next major horizontal line to the left as shown in FIG. 2). The plane of the intermediate face may vary a few degrees from being parallel to one of the adjacent major horizontal distant line planes but is preferably parallel as this promotes better alignment and ease of assembly. Both the interior corner 54 and exterior corner 56 have approximately the same angle in the preferred embodiment and it is approximately 115 degrees when the major angle in 65 degrees and the minor angle is 55 degrees.

Figure 3:
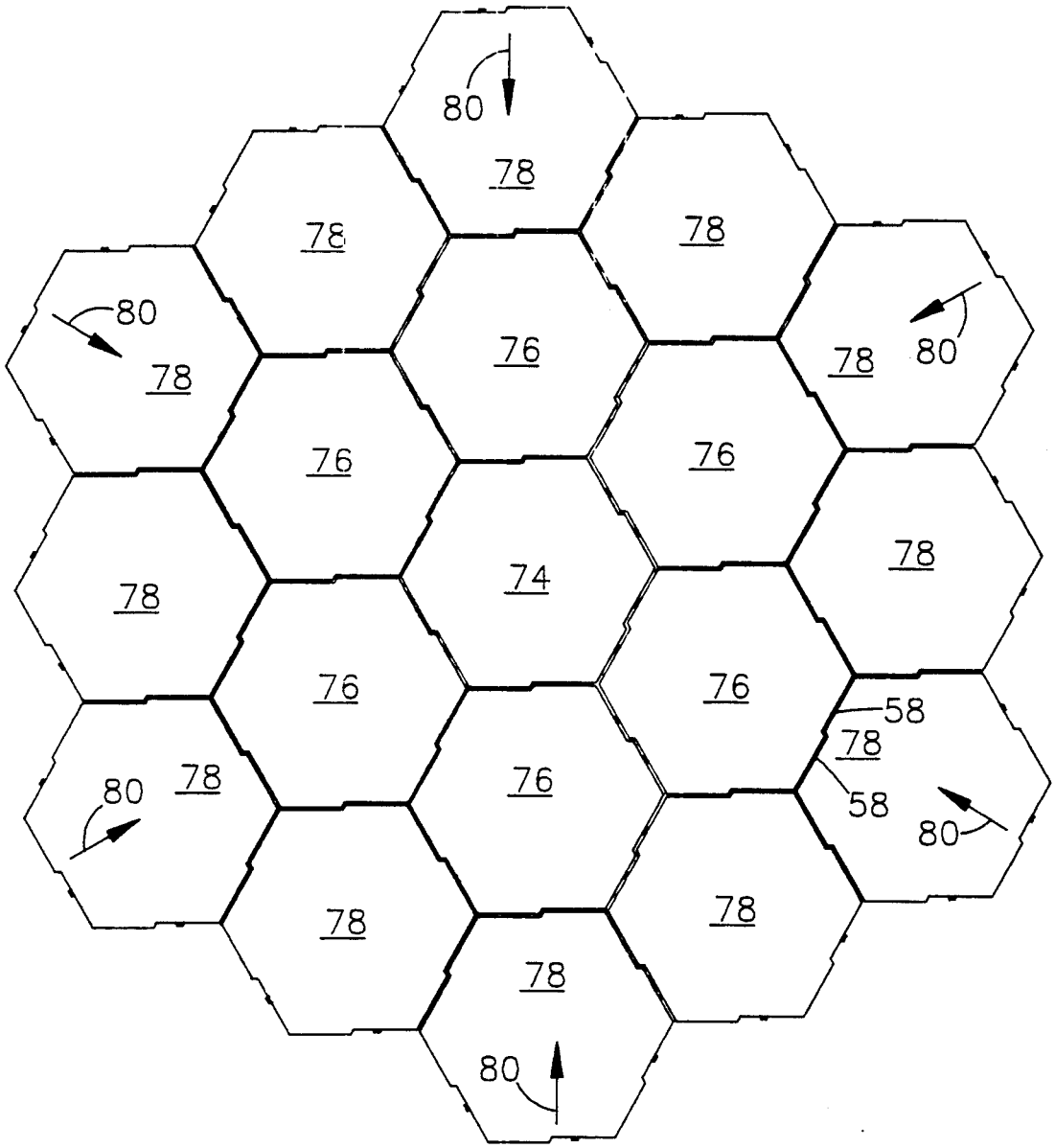
FIG. 3 is a plan view of 19 blocks assembled together.

With reference to FIG. 3, there is shown an array of 19 blocks. The array is arranged around a center block 74 with an inner perimeter of six blocks 76 and an outer perimeter of twelve blocks 78. A preferred block may have a weight of approximately 23 pounds so the 19 blocks can be handled as a group, provided uniform inwardly directed peripheral pressure is applied at approximately the six clamping positions 8 identified in FIG. 3. Pressure is applied toward the center block 74 and is sufficient to hold the blocks together to be placed adjacent to already laid paving. Suitable placing machines are readily available such as the Optimus Laying Machine available from Optimus GmbH whose address is Ramsloh Industrie Strasse 12, Post Office Box 1151, D-2915, Saterland 1, West Germany. A suitable special jig must be provided for applying the pressure from the six peripheral positions.

FIG. 3 also shows how the spacer bars 58 serve to space the blocks from one another at a predetermined distance.

When being placed adjacent to already placed paving block the maximum angle of rotation required for the 19 blocks to be orientated towards those already in position is 60 degrees. This, together with the fact that the blocks can be picked up from six different directions, is estimated to save 20 seconds per pickup which in a large paving installation amounts to a considerable saving in the cost of installation.

In laying the block, standard paving techniques are used with preferably a suitable bedding provided of sand which is not compacted until the concrete paving blocks are laid thereover. Then the blocks are vibrated which causes some of the bedding sand to be vibrated up into the space between the blocks provided by the spacer bars. Then dry sand is spread over the area of the paving blocks. This sand is a suitable jointing sand which is preferably angular quartzite or granite sand as opposed to a more rounded sand. This is well known in the industry. This sand is then vibrated to fill the spaces between the blocks and in effect interlocks the blocks together but in a manner that they have a certain measure of flexibility when subjected to loads such as an airplane wheel. Because of the blocks being interlocked to one another by the jointing sand, pressure placed on one block in a vertical direction is spread horizontally to adjacent blocks so that a larger number of blocks serve to provide support.

Because of the unique angles and the relationship between mating blocks provided by the interior/exterior and joining intermediate faces, the blocks have a number of lock points which prevent them from migrating apart under loading, especially when an airplane is turning, to provide a substantially improved paved surface especially for heavy duty industrial areas. Also, the side surface area to surface area is increased to provide better interlocking.

It is to be understood that the following claims are intended to cover all of the generic and specific features of the invention herein described. It is to be further understood that the specific embodiment shown is not to be construed in the limiting sense but merely to depict and illustrate the principles of the present invention. Modifications may be devised by those with skill in the art which will not depart from the spirit or scope of the protection as set forth in the following claims.

What is claimed is:

1. A paving block having 20 faces comprising: a top face lying in a plane and having a major horizontal dimension;

a bottom face lying in a plane spaced from and parallel to said plane of said top face;

six rectangular, vertical exterior faces each having a vertical corner edge, a horizontal top edge, a horizontal bottom edge and a vertical exterior edge;

six rectangular vertical interior faces each having a vertical corner edge, a horizontal top edge, a horizontal bottom edge and a vertical interior edge;

six rectangular vertical intermediate faces each having a vertical exterior edge, a vertical interior edge, a horizontal top edge and a horizontal bottom edge;

six vertical primary corners uniformly spaced about the periphery of said block with each formed by said vertical corner edge of one of said exterior vertical faces joined to said vertical corner edge of one of said interior vertical faces;

said primary corners include an angle of approximately 120 degrees composed of a major angle between said exterior face and a bisecting vertical plane in which said major horizontal dimension lies and a minor angle between said interior face and said bisecting vertical plane;

six vertical exterior corners each formed by said vertical exterior edge of one of said exterior vertical faces joined to said vertical exterior edge of one of said intermediate vertical faces; and six vertical interior corners each formed by said vertical interior edge of one of said interior vertical face joined to said vertical interior edge of one of said intermediate vertical faces.

2. The paving block of claim 1 which further includes six vertical spacer bars equally spaced about the periphery of said block and integrally with each of either said interior faces or said exterior faces.

3. The paving block of claim 2 wherein said spacer bars are between approximately 0.5mm and approximately 3 mm in thickness.

4. The paving block of claim 3 wherein said spacer bars are approximately 1.5 pl mm in thickness.

5. The paving block of claim 1 wherein said major angle varies between approximately 62½ degrees and 67½ degrees and said minor angle varies between approximately 57½ degrees and 52½ degrees.

6. The paving block of claim 1 wherein said major angle is approximately 65 degrees and said minor angle is approximately 55 degrees.

7. The paving block of claim 1 in which said intermediate faces lie in a plane that is approximately parallel to said bisecting vertical plane.

8. The paving block of claim 7 arranged in an array of 19 blocks arranged symmetrically in a tight assembly around a central block with an inner perimeter of six blocks and an outer perimeter of 12 blocks which array is easily handled by clamps at six peripheral positions for mechanically placing in an area to be paved with a maximum rotation of only 60 degrees required to mate with other block arrays.

9. A paving block having 20 faces comprising:

a top face lying in a plane;

a bottom face lying in a plane spaced from and parallel to said plane of said top face;

six rectangular, vertical exterior faces each having a vertical corner edge, a horizontal top edge, a horizontal bottom edge and a vertical exterior edge;

six rectangular vertical interior faces each having a vertical corner edge, a horizontal top edge, a horizontal bottom edge and a vertical interior edge;

six rectangular vertical intermediate faces each having a vertical exterior edge, a vertical interior edge, a horizontal top edge and a horizontal bottom edge;

six vertical primary corners uniformly spaced about the periphery of said block with each formed by said vertical corner edge of one of said exterior vertical faces joined to said vertical corner edge of one of said interior vertical faces;

six vertical exterior corners each formed by said vertical exterior edge of one of said exterior vertical faces joined to said vertical exterior edge of one of said intermediate vertical faces;

six vertical interior corners each formed by said vertical interior edge of one of said interior vertical face joined to said vertical interior edge of one of said intermediate vertical faces; and said spacing between said top face and said bottom face is between approximately 9 cm and approximately 12 cm and the major horizontal dimension of said top face and said bottom face is between approximately 15 cm and approximately 30 cm.

10. The paving block of claim 9 wherein said spacing between said top space and said bottom space is approximately 10 cm and the major horizontal dimension of said top face and said bottom face is approximately 25 cm.

* * * * *